US011390503B2

(12) United States Patent
Schumacher et al.

(10) Patent No.: US 11,390,503 B2
(45) Date of Patent: Jul. 19, 2022

(54) DROP TABLE WITH SHEARING DRIVE COUPLING

(71) Applicant: Nabholz Construction Corporation, Conway, AR (US)

(72) Inventors: Stephen Harold Schumacher, Sandy Hook, CT (US); Mark M. O'Donnell, Danbury, CT (US)

(73) Assignee: NABHOLZ CONSTRUCTION CORPORATION

( * ) Notice: Subject to any disclaimer, the term of this patent is extended or adjusted under 35 U.S.C. 154(b) by 215 days.

(21) Appl. No.: 16/459,807

(22) Filed: Jul. 2, 2019

(65) Prior Publication Data

US 2021/0002109 A1 Jan. 7, 2021

(51) Int. Cl.
*B66F 3/44* (2006.01)
*B66F 7/10* (2006.01)

(52) U.S. Cl.
CPC . *B66F 3/44* (2013.01); *B66F 7/10* (2013.01)

(58) Field of Classification Search
CPC ..... B66F 3/44; B60S 9/00; B60S 9/04; B60S 9/10; B60S 9/18; B60S 9/20; B60S 9/22
USPC ..... 254/89 R, 418–427
See application file for complete search history.

(56) References Cited

U.S. PATENT DOCUMENTS 1,319,833 A 10/1919 Bingaman
1,450,702 A 4/1923 Otis
1,564,828 A 12/1925 Coffey
1,632,256 A 6/1927 Walter
1,685,098 A 9/1928 Sklovsky
1,707,923 A 4/1929 Phelps
1,773,746 A 8/1930 Nagell
1,796,803 A * 3/1931 Nelson ..... F16D 9/06 464/33
1,802,592 A 4/1931 Christie
1,866,798 A 7/1932 Christie
2,097,133 A 10/1937 Richardson
2,178,632 A 11/1939 Holmes
2,191,710 A 2/1940 Fones
2,585,113 A * 2/1952 Gredell ..... F16D 9/06 464/32
2,655,115 A 10/1953 Holdeman et al.
2,718,851 A 9/1955 Holdeman
2,828,161 A * 3/1958 Whitney ..... F16D 9/06 464/33
3,071,945 A 1/1963 Shomo
3,251,311 A 5/1966 Saxonmeyer
3,405,541 A * 10/1968 Whitfield ..... F16D 9/06 464/33
3,472,046 A 10/1969 Potter
3,602,057 A * 8/1971 McEntire ..... F16D 9/06 74/412 R
4,015,824 A 4/1977 Profet
(Continued)

FOREIGN PATENT DOCUMENTS

CN 109080593 A * 12/2018 ..... F16D 9/06

*Primary Examiner* — Joseph J Hail
*Assistant Examiner* — Jonathan R Zaworski

(57) ABSTRACT

A drop table can employ one or more shearing drive couplings to optimize lifting operations. The drop table can have a motor physically attached to a first lifting column via a first rotating input shaft and to a second lifting column via a second rotating input shaft. Each rotating input shaft is connected to the motor by a drive coupling having a shearing insert positioned between a drive shaft and a collar.

18 Claims, 3 Drawing Sheets

(56) References Cited

U.S. PATENT DOCUMENTS

| | | | | |
|---|---|---|---|---|
| 5,404,968 | A | 4/1995 | Fletcher | |
| 5,409,238 | A * | 4/1995 | Norris | F16D 9/06 273/392 |
| 5,573,083 | A | 11/1996 | Fletcher et al. | |
| 6,244,390 | B1 | 6/2001 | Yeo et al. | |
| 6,863,159 | B2 | 3/2005 | Rauch | |
| 7,198,135 | B2 | 4/2007 | Naber | |
| 7,311,331 | B2 * | 12/2007 | McGlothlin | B60D 1/66 280/475 |
| 7,900,562 | B2 | 3/2011 | Esposti et al. | |
| 7,954,602 | B2 | 6/2011 | Stanislao | |
| 8,028,973 | B2 | 10/2011 | Ford et al. | |
| 8,083,034 | B2 | 12/2011 | Bordwell et al. | |
| 8,251,184 | B2 | 8/2012 | De Jong | |
| 8,286,754 | B2 | 10/2012 | Cohn | |
| 8,397,643 | B2 | 3/2013 | Esposti et al. | |
| 8,567,761 | B2 | 10/2013 | De Jong et al. | |
| 8,919,476 | B2 | 12/2014 | Holland et al. | |
| 8,939,296 | B2 | 1/2015 | Weyler et al. | |
| 9,045,149 | B2 | 6/2015 | Knapp et al. | |
| 9,073,558 | B2 | 7/2015 | Knapp et al. | |
| 9,126,607 | B2 | 9/2015 | Knapp et al. | |
| 9,193,572 | B2 | 11/2015 | Finkbeiner et al. | |
| 9,267,258 | B2 | 2/2016 | Knapp et al. | |
| 9,295,324 | B2 | 3/2016 | Knapp et al. | |
| 9,758,359 | B2 | 9/2017 | Kamphuis et al. | |
| 9,764,933 | B2 | 9/2017 | Knapp et al. | |
| 9,764,934 | B2 | 9/2017 | Knapp et al. | |
| 9,970,325 | B2 | 5/2018 | Oden et al. | |
| 10,000,221 | B2 | 6/2018 | Knapp et al. | |
| 11,047,426 | B2 * | 6/2021 | Wehner | F16D 3/223 |
| 2012/0193590 | A1 | 8/2012 | Horwath et al. | |
| 2016/0039646 | A1 | 2/2016 | Knapp | |

* cited by examiner

DROP TABLE WITH SHEARING DRIVE COUPLING

SUMMARY

A drop table, in accordance with various embodiments, has a motor physically attached to a first lifting column via a first rotating input shaft and to a second lifting column via a second rotating input shaft. Each rotating input shaft is connected to the motor by a drive coupling consisting of an inner shaft attached to collar via a shearing insert.

Operation of a drop table, in some embodiments, involves connecting a first lifting column to a motor via a first drive coupling and connecting a second lifting column to the motor via a second drive coupling. Activation of the motor rotates each drive coupling to provide vertical motion of a platform. Upon experiencing a shear force above a predetermined physical threshold of a shearing insert of the first drive coupling, the motor is automatically disconnected from the first lifting column.

DETAILED DESCRIPTION

This disclosure generally relates to embodiments of a drop table with one or more drive couplings configured and operated to provide optimized lifting operations.

As heavy machinery, such as locomotives, industrial equipment, and large-scale tools, have become more sophisticated over time, a need remains for maintenance of assorted components of the machinery. Maintenance can involve the removal of relatively heavy, and potentially cumbersome, components from machinery and the subsequent transport of those components to a service station where maintenance operations are conducted. After maintenance work is concluded, the heavy components are then transported back to the machinery where installation takes place. Throughout these maintenance operations, the safety, efficiency, and reliability of maintenance equipment and mechanisms are jeopardized by the amount of strain placed one the equipment by the machinery components.

When transportation of machinery components for maintenance operations involves lifting, the maintenance equipment can experience extreme loads that gradually, or suddenly, degrade operation, which necessitates lengthy and expensive repairs. The operation of such maintenance equipment can also be very dangerous as loads can move and equipment can break under large amounts of force. Hence, various embodiments are directed to implementing drive couplings that shear and disconnect under predetermined amounts of force into maintenance equipment to optimize equipment operation, efficiency, and safety.

Figure 1:
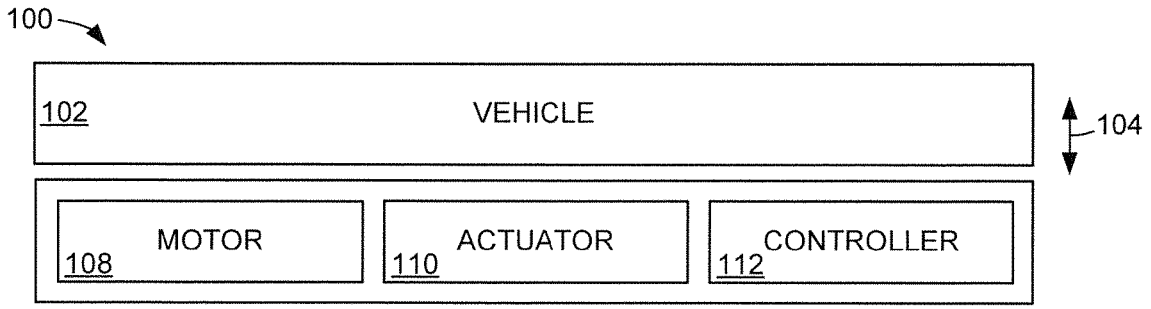
FIG. 1 is a block representation of an example maintenance system in which various embodiments can be practiced.

FIG. 1 depicts a block representation of an example maintenance system 100 in which various embodiments can be practiced. The system 100 can be configured to service any type, and size, of machinery, such as a vehicle 102. It is contemplated that more than one vehicle 102 can concurrently be accessed and serviced, but such arrangement is not required or limiting.

Although assorted maintenance can be facilitated without physically moving the vehicle 102, such as engine tuning or joint greasing, other maintenance requires the separation of one or more components from the vehicle 102. Such separation can be conducted either by lifting the vehicle 102 while a component remains stationary or by lowering the component while the vehicle 102 remains stationary. Due to the significant weight and overall size of some vehicles 102, such as a locomotive engine or railcar, the maintenance system 100 is directed to moving a component vertically, as represented by arrow 104, with a lifting mechanism 106 while the remainder of the vehicle 102 remains stationary.

The lifting mechanism 106 can consist of at least a motor 108, or engine, that powers one or more actuators 110 to physically engage and move vehicle components. A local controller 112 can direct motor 108 and actuator 110 operation and may be complemented with one or more manual inputs, such as a switch, button, or graphical user interface (GUI), that allow customized movement of the vehicle component. The local controller 112 can conduct a predetermined lifting protocol that dictates the assorted forces utilized by the motor 108 and actuator 110 to efficiently and safely conduct vertical component displacement.

Figure 2:
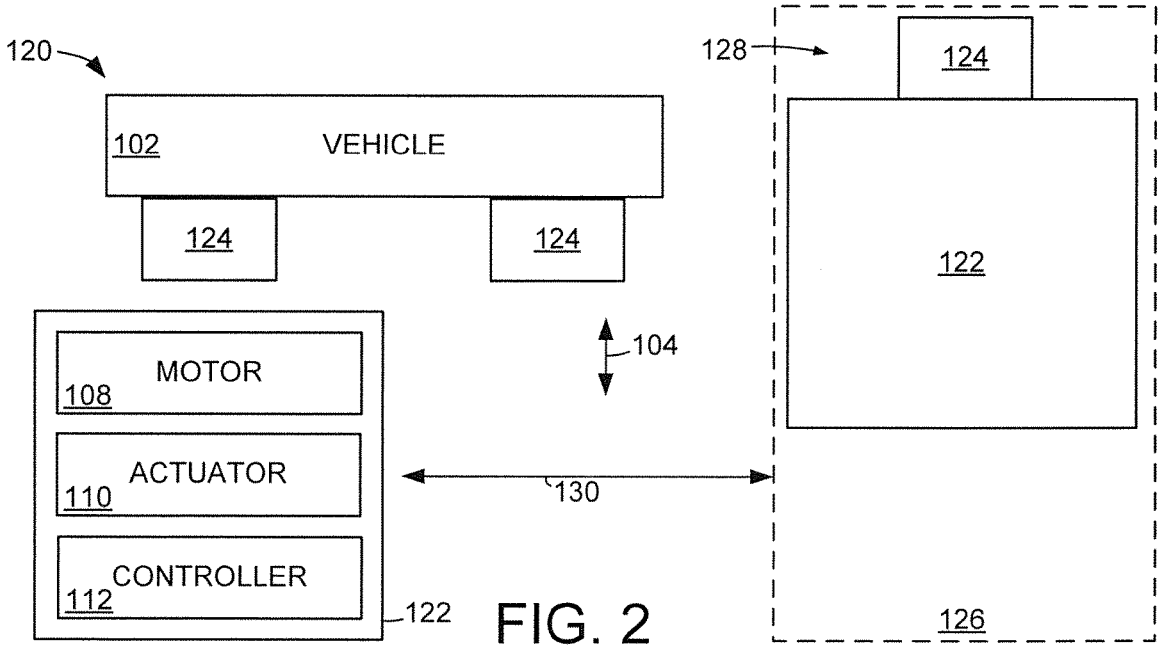
FIG. 2 depicts a block representation of an example drop table system arranged in accordance with various embodiments.

In accordance with some embodiments, the lifting mechanism 106 can be characterized as a drop table onto which the vehicle 102 moves to position a component in place to enable component removal, and subsequent installation after service has been performed. FIG. 2 depicts a block representation of an example drop table system 120 arranged to provide maintenance operations for a vehicle 102. A drop table 122 can consist of one or more motors 108, actuators 110, and controllers 112 that are utilized to engage a vehicle component 124, lower the component 124 to separate it from the vehicle 102, move the component 124 to a service shaft 126, and subsequently raise the component 124 into a service area 128 at the top of the service shaft 126.

With the combination of vertical component movement 104 and horizontal component movement 130, the drop table 122 can experience a broad range of forces that jeopardize system 120 operation and safety. That is, a drop table 122 can encounter differing forces from diverse vectors during the lowering, horizontal translation, and raising of a component 124 that has a substantial weight, such as 5 tons or more, which may place a diverse variety of strain on at least the moving aspects of the drop table 122. Hence, the range of movement of the drop table 122 has a greater risk of part failure and safety hazards compared to lifting mechanisms simply employed for vertical movement 104.

Figure 3A:
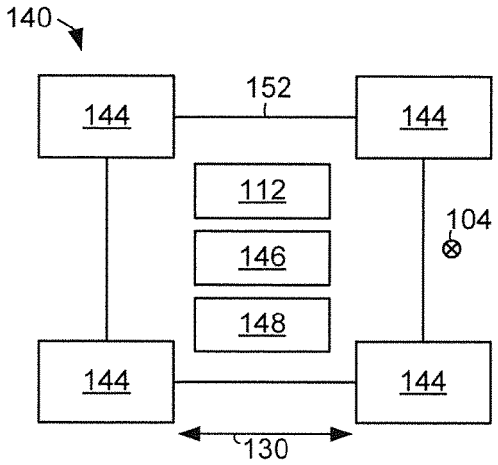
FIGS. 3A & 3B represents portions of an example drop table capable of being used in the systems of FIGS. 1 & 2.
Figure 3B:
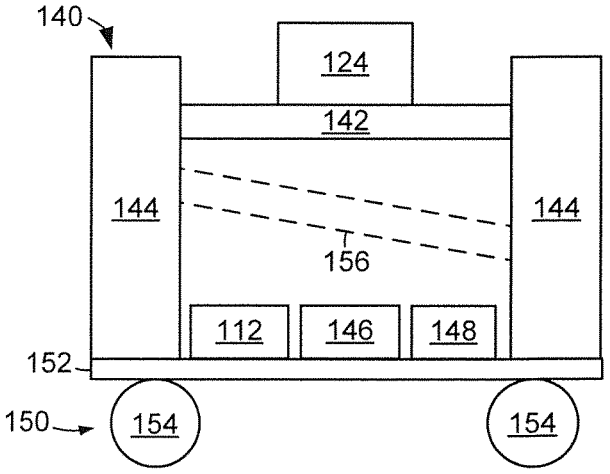

FIGS. 3A & 3B respectively depict block representations of portions of an example drop table 140 that can be utilized in the systems 100/120 of FIGS. 1-2 to conduct vehicle component maintenance. The top view of FIG. 3A displays a platform 142 disposed between and physically attached to multiple lifting columns 144. As directed by a local controller 112, one or more lifting motors 146, or engines, can articulate aspects of the respective columns 144 to move the platform 142 in the vertical direction 104. The controller 112 may further direct one or more transverse motors 148, or engines, to activate a drive line 150 and move the platform 142 along the horizontal direction 130.

It is contemplated that one or more lifting columns 144 are physically separated from the platform 142, but such configuration would necessitate individual motors 146/148 for each column 144 along with complex spatial sensing and coordination to ensure a vehicle component 124 is securely lifted and moved. Instead, the platform 142 physically unifies the respective lifting columns 144 and provides a foundation onto which the vehicle component 124 can rest and provide a consistent center of gravity throughout lifting and horizontal movement activities.

FIG. 3B displays side view and an example physical layout of the drop table 140 where a base 152 remains stationary while the platform 142 is vertically translated. The base 152 provides a secure foundation for the various motors 146/148, and associated transmissions, that power the respective lifting columns 144. The base 152 further anchors the drive line 150 and number of constituent rollers 154, which can be wheels, castors, trucks, or other assembly utilizing a bearing that allows horizontal movement 130. During normal operation, the assorted lifting columns 144 provide uniform platform 142 lifting and lowering. However, the fact that the multiple lifting columns 144 can independently experience degraded operation and/or failures increases the operational risk of less than all of the columns 144 experiencing an error.

When a lifting column 144 experiences degraded operation and/or failure while other columns 144 continue to operate, the platform 142 can become unstable, as illustrated by segmented platform 156, and the very heavy component 124 can be at risk of damage and/or damaging the drop table 140. Hence, the use of independent lifting motors 146, or independent lifting columns 144 separate from a platforms 142, can be particularly dangerous. Furthermore, independent lifting columns 144 provide less physical space for motors 146 and limit the available motor size and power that can be safely handled by a column 144, which reduces the efficiency and safety of lifting heavy components 124, such as over 10 tons.

In contrast to independent lifting columns 144 having independent lifting motors 146, it is contemplated that a single motor can be employed to power the respective columns 144 collectively. While the base 152 could provide enough space and rigidity to handle a single motor/engine 146, the failure rates and operational longevity of a motor/engine 146 capable of lifting tens of tons of components 124 can involve increased service times and frequency that can be prohibitive in terms of drop table 140 operational efficiency. In addition, it is noted that large parasitic energy losses can be experienced through transmission that translates the power output of a single motor/engine 146 to four separate lifting columns 144.

Accordingly, various embodiments employ a lifting motor 146 to power two separate lifting columns 144. The combination of two lifting motors 146 to power four columns 144 provides an enhanced motor efficiency via relatively simple transmissions, lower service times/frequency, and relatively simple motor 146 coordination compared to independent columns 144 or a single motor powering four columns 144.

Figure 4:
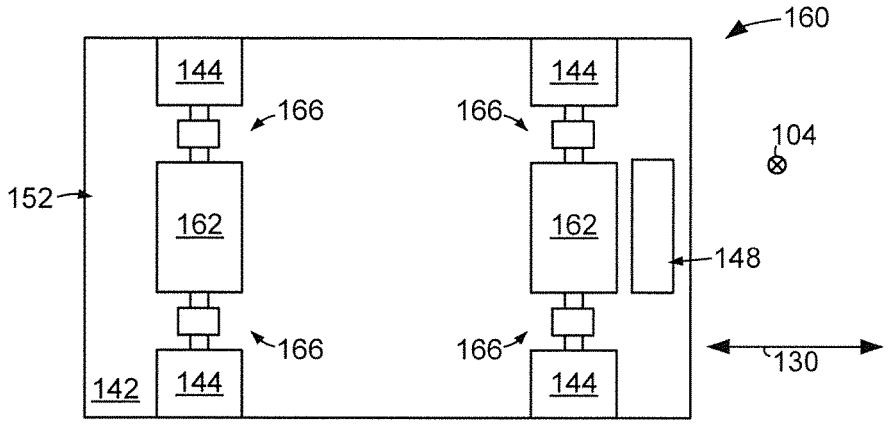
FIG. 4 displays a block representation of portions of an example drop table arranged in accordance with assorted embodiments.

FIG. 4 depicts a block representation of portions of an example drop table 160 configured in accordance with some embodiments to provide efficient and safe component 124 movement during maintenance operations. The top view of FIG. 4 conveys how a first lifting motor 162 and a second lifting motor 164 can each be mounted to the drop table base 152 and respectively connect to a pair of lifting columns 144 via separate transmissions 166. The assorted transmissions 166 can be matching, or dissimilar, assemblies that translate rotational output of the motors 162/164 into vertical movement of platform 142 connected to each column 144.

The operation and physical configuration of the respective lifting columns 144 is not limited, but can involve a rotating core that selectively articulates a nut and platform traveler upward or downward depending on the rotation of the core. Hence, each motor 162/164 and transmission 166 is designed and operated to provide bidirectional operation with enough precision to prevent shock, physical trauma, and movement of a component 124 attached to the platform 142. The respective motors 162/164 may be configured with a single output while some embodiments utilize motors with dual outputs that operate concurrently with matching power in response to electrical activation.

During operation, it is noted that mechanical, and electrical, degradation can occur unevenly between the two lifting columns 144 connected to the respective motors 162/164. The failure of a lifting column 144 or transmission 166 on one output of a motor 162/164 while the lifting column 144 and transmission 166 connected to the other output of the motor 162/164 remains operating can lead to motor failure as tension is disproportionately utilized. Likewise, a failure of both transmissions 166 connected to a motor 162/164 results in a failed motor due to excessive heat and friction. Such motor failures are costly to repair in terms of money, time, and inefficiency of a maintenance system.

With these issues in mind, assorted embodiments are directed to adding a drive coupling that shears in response to a predetermined amount of force to each transmission 166 so that excessive force experienced by a lifting column 144 fails at the transmission 166 and not the motor 162/164. That is, the addition of a shearing drive coupling to each transmission 166 ensures lifting column 144 and/or transmission 166 failures do not result in subsequent motor 162/164 failure. It is noted that a shearing drive coupling cannot prevent all motor 162/164 failures, but the isolation of failures to the transmissions 166 lessen the severity of motor failures and provide for easier and more cost efficient motor repairs compared to replacing a motor 162/164.

Figure 5:
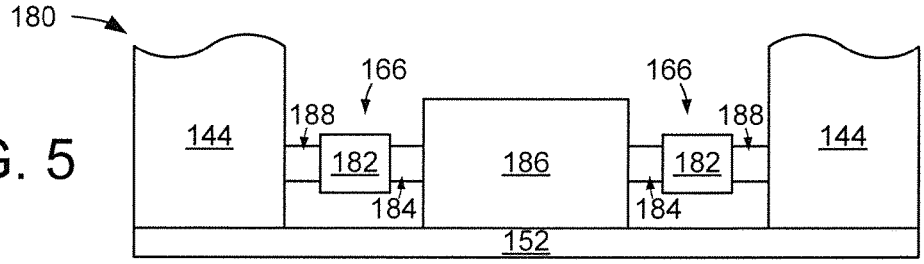
FIG. 5 depicts portions of an example drop table configured and operated in accordance with some embodiments.

FIG. 5 is a block representation of a portion of an example drop table 180 that implements shearing drive couplings 182 to each transmission 166. The respective shearing couplings 182 may be constructed with different operational characteristics, such as shear tolerance, material, and size, but various embodiments utilize shearing couplings 182 with matching operational characteristics. Each shearing drive coupling 182 is physically attached between an output shaft 184 of a motor 186 and a lifting shaft 188 of the transmission 166 that rotates to drive the raising, or lowering, of portions of a lifting column 144 and attached platform 142.

The shearing drive couplings 182 can be individually, and collectively, tuned to provide optimal lifting column 144 operation with respect to efficiency and safety. By mechanically constructing each drive coupling 182 with a shearing component that fails in response to forces in excess of predetermined threshold, the respective transmissions 166 can automatically disconnect the motor 186 from a lifting column 144 and mitigate the damage experienced by the motor 186 from the excessive operational forces. It is noted that the drop table 180 can be configured to prevent an elevated platform 142 from falling in response to the physical disconnection of a drive coupling 182. The drop table 180 may further be configured to automatically alter motor 186 operation to a protection mode, such as electrical deactivation or reduced power output, in response to physical disconnection of a drive coupling 182.

FIGS. 6A-6D respectively depict perspective and cross-sectional line representations of portions of an example drop table transmission 200 configured and operated in accordance with some embodiments to provide optimal lifting operations. A transmission 200 can have a drive shaft 202 that attaches to a collar 212 to allow unitary rotation and translation of motor output shaft movement to an attached lifting column.

Figure 6A:
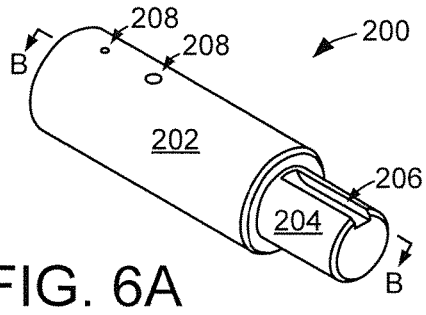
FIGS. 6A-6D respectively convey portions of an example drop table employed in accordance with various embodiments.

As shown in FIG. 6A, a drive shaft 202 can have an enlarged diameter that supports a protrusion 204 that is sized to fit within and physically engage the collar 212. It is contemplated the protrusion 204 has one or more recesses 206 where a shearing insert 222 can fit to engage the collar 212, as displayed in FIG. 6D. A recess 206 can be any size and shape defined by linear, or curvilinear, surfaces. Some embodiments construct multiple separate, or interconnected, recesses 206 into a protrusion 204 to allow multiple inserts 222 to be concurrently utilized.

Figure 6C:
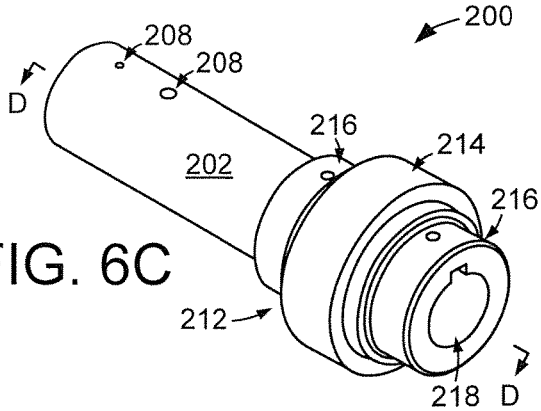
Figure 6B:
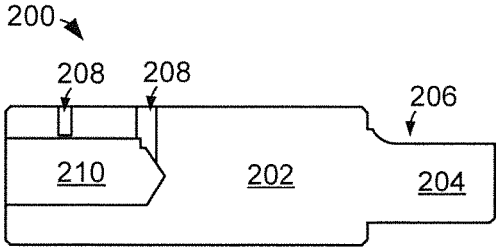

The cross-sectional view of FIG. 6B illustrates how the drive shaft 202 has an attachment opening 210 that allows the shaft 202 to be physically coupled to another transmission component, such as a lifting shaft. Such physical connection may be aided by one or more fasteners and/or fastening material, such as glue, that extend through a fastening aperture 208. The use of one or more fasteners to connect the drive shaft 202 to another transmission component can provide a supplemental failure mechanism that physically disconnects in response to encountered force above a predetermined threshold. That is, the fasteners, or fastening material, that extends through the respective apertures 208 can be selected and installed to have a plastic, or elastic, deformation in response to force that is above the threshold of the shearing insert 222, which ensures physical disconnection of the transmission 200 from a motor in response to encountered force above a critical amount.

In FIG. 6C, the drive shaft 202 is shown inserted into the collar 212 to create a shearing drive coupling. The collar 212 is configured with a non-limiting balancing portion 214 that has an enlarged diameter and is disposed between receiving portions 216 that respectively have reduced diameters. The receiving portions 216 may physically attach to other transmission components, such as the drive shaft 202 or output shaft of a motor, via a keyed opening 218, which can aid the alignment and mechanical operation of the transmission 200 once connected.

Figure 6D:
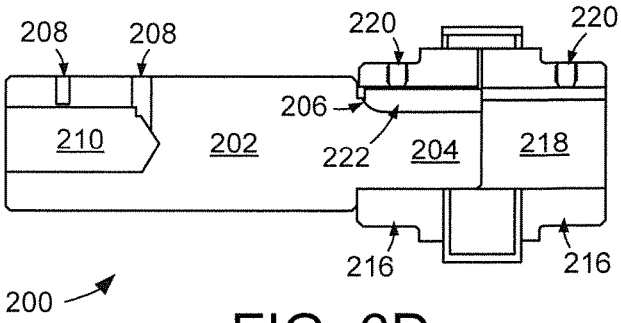

An example assembly of a shearing drive coupling is shown in the cross-sectional view of FIG. 6D where the shearing insert 222 is positioned in the drive shaft recess 206 to contact the interior of a receiving portion 216 of the collar 212. It is contemplated, but not required, that the shearing insert 222 fills some, or all, of a keyed aspect of the inner chamber of the collar 212. Such a keyed aspect may be similar, or dissimilar, to the linear cutout of the opening 218 that creates horizontal and radial asymmetry for the opening 218. Although not required, the collar 212 can be physically secured to the shearing insert 222 via fasteners, or fastening material, that extends through connection apertures 220.

The shearing insert 222 may be constructed of any material, but in some embodiments consists of a polymer that is dissimilar from the material of the drive shaft 202 or collar 212. The shearing insert 222 is a separate component that is installed when the drive shaft 202 is attached to the collar 212, which allows for efficient replacement in the event forces cause the insert 222 to shatter, break, or otherwise deform. It is noted that the size and shape of the drive shaft protrusion 204 results in the drive shaft 202 mechanically disconnecting from the collar 212 in response to physical failure of the shearing insert 222. In other words, the drive shaft 202 and collar 212 will not collectively rotate and the drive shaft 202 will simply spin inside the collar 212 once the shearing insert 222 fails. Hence, the shearing drive coupling can mechanically disconnect a transmission 200 from a motor simply with excessive rotational forces and without vertical or transverse transmission component movement, which prevents transmission component failure subsequent to shearing insert 222 failure.

Figure 7:
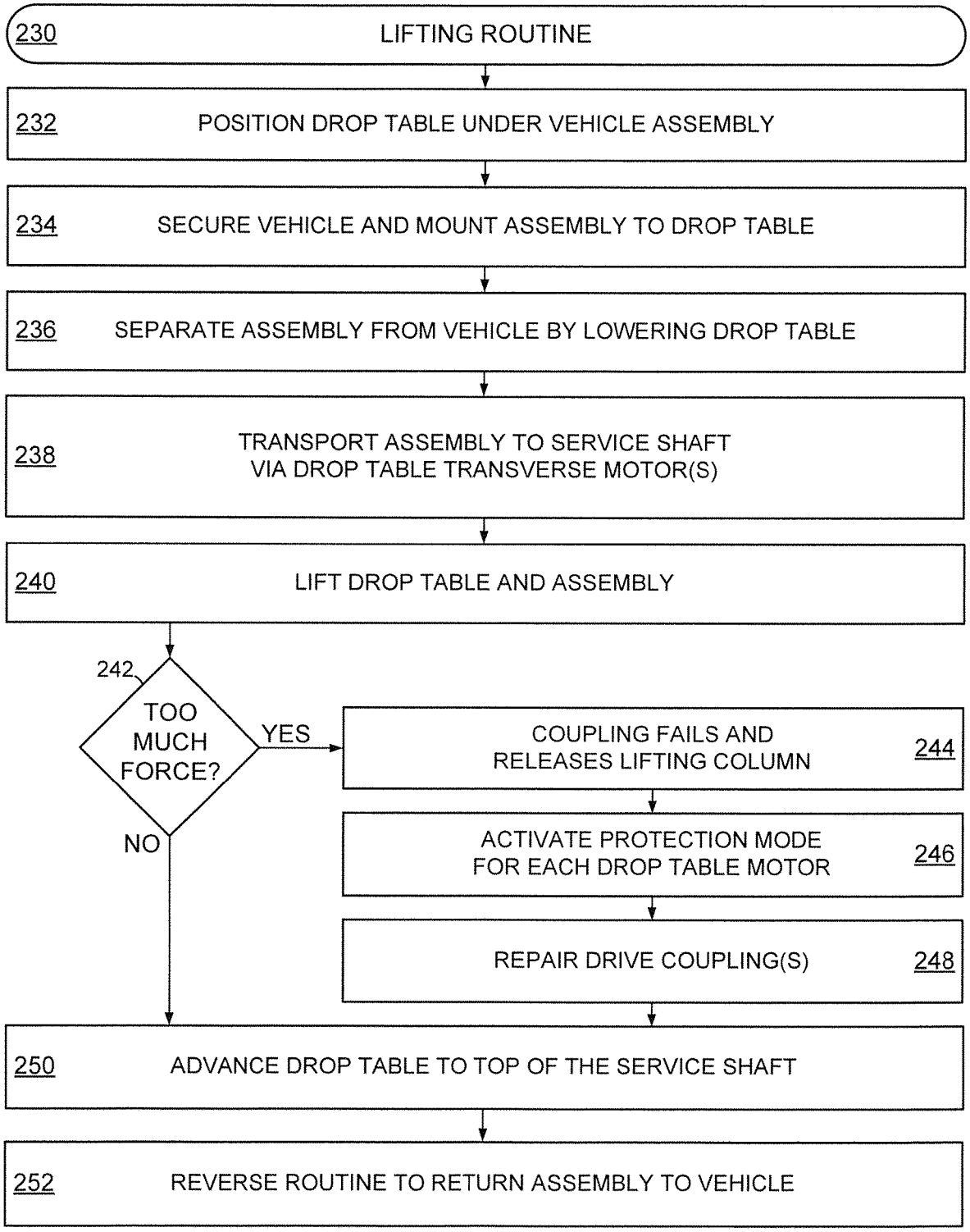
FIG. 7 is an example lifting routine that may be executed with assorted embodiments of FIGS. 1-6D.

FIG. 7 is a flowchart of an example lifting routine 230 that can be carried out with the assorted embodiments of FIGS. 1-6D. The routine 230 initially sets up a maintenance system that utilizes at least one drop table configured with at least one shearing drive coupling. Some embodiments result in a drop table having four lifting columns powered by a pair of motors respectively connected to transmissions via one or more shearing drive couplings. It is noted that the setting up of a maintenance system may involve various physical and electrical assembly along with testing.

The installation and proper set up of the maintenance system allows step 232 to maneuver vehicle over the drop table. For example, step 232 can involve driving a locomotive over the drop table so that a rail wheels, suspension, and trucks are aligned with the drop table to ensure a center of gravity that is safely conducive to lifting operations. Step 234 physically secures the machinery and step 236 proceeds to lower the drop table and attached machinery component, or component assembly, into a maintenance shaft. Step 238 then activates at least one transverse motor of the drop table to horizontally move the drop table into alignment with a service shaft. It is contemplated that a transverse motor is not physically located on the drop table and instead is mounted within the maintenance shaft and connected to the drop table via a cable, chain, wire, or shaft.

Once the drop table is aligned with the service shaft, step 240 activates the respective lifting motors to being raising the drop table platform and attached machinery component (s). Decision 242 mirrors the mechanical operation of one or more shearing drive couplings that attach a motor to an activated lifting column by monitoring encountered shear force. In the event a shearing drive coupling experiences a shear force above a predetermined mechanical threshold of the shearing insert(s) of the drive coupling, step 244 is induced and the drive coupling is physically disconnected to release the transmission from the motor.

It is contemplated that the physical disconnection of one shearing drive coupling in step 244 will cause the motor to spontaneously apply excessive shear force to the other attached shearing drive coupling that causes that shearing insert to fail and disconnect that transmission and lifting column from the motor. Hence, if both connected shearing drive couplings disconnect concurrently, or experience a cascade failure aided by the motor, the motor will be free of any connected components and will enter an over-spin protection mode in step 246. That is, a motor will automatically diminish power or deactivate in response to being active when no load is placed on either output shaft. In contrast, having a single output shaft under load and another disconnected from a transmission will result in heat, friction, and failures in the motor.

The physical disconnection of the motor from the respective transmissions will cause the platform to slow or halt while placing heightened forces on the remaining shearing drive couplings of the drop table. By customizing the shear force tolerance of the shearing drive couplings and the motor, a single motor will not be able to lift a machinery component without applying excessive shear force to the shearing drive couplings that results in disconnection of the remaining transmissions in step 244 and motor protection mode in step 246. Hence, the shearing drive couplings are configured to collectively fail and protect the respective drop table motors, gearbox, rotating core, and structural integrity of the platform and base in response to a single drive coupling failure, even if a mechanical or electrical error, degraded operation, or failure is not present in each drive coupling of the drop table.

While inconvenient for the drop table to collectively fail in response to experiencing excessive force on a single shearing drive coupling, the respective drive couplings can be replaced quickly and efficiently while the platform and attached machinery component(s) are locked and prevented from falling in step 248. The installation of new shearing inserts in the failed drive couplings may coincide with the repair, or maintenance, of various other drop table components, such as greasing joints or removing debris, that contributed to the initial experience of high shear forces.

At the conclusion of step 248, or if no excessive shear force is experienced in decision 242, step 250 advances the drop table platform to a fully raised position where maintenance can readily be completed on the machinery component(s). Completion of such maintenance prompts routine 230 to operate in reverse in step 252 while decision 242 monitors drop table lowering operations at one end of the maintenance shaft and subsequent raising underneath the vehicle until the component(s) are fully installed back onto the vehicle.

Through the assorted embodiments of a drop table and maintenance system, safety and efficiency is heightened by involving one or more shearing drive couplings. The ability to optimize the amount of force a coupling can withstand before a shearing insert fails ensures smooth and precise operation under normal conditions. The inevitable degradation of operating conditions, errors, and/or failures over time results in mitigation of motor damage with a failed drive coupling and a subsequent relatively simple and efficient repair by replacing a shearing insert, which is safer and more desirable than replacing or repairing a motor.

It is to be understood that even though numerous characteristics of various embodiments of the present disclosure have been set forth in the foregoing description, together with details of the structure and function of various embodiments, this detailed description is illustrative only, and changes may be made in detail, especially in matters of structure and arrangements of parts within the principles of the present technology to the full extent indicated by the broad general meaning of the terms in which the appended claims are expressed. For example, the particular elements may vary depending on the particular application without departing from the spirit and scope of the present disclosure.

What is claimed is:

1. An apparatus comprising a motor physically attached to a first lifting column via a first rotating input shaft and to a second lifting column via a second rotating input shaft, each rotating input shaft connected to the motor by a shearing drive coupling comprising an inner shaft attached to a collar via a shearing insert, the shearing insert of the shearing drive coupling connected to the first rotating input shaft configured to have a different shear force tolerance than the shearing insert of the shearing drive coupling connected to the second rotating input shaft.

2. A method comprising:

connecting a first lifting column to a motor via a first shearing drive coupling and a first rotating input shaft;

connecting a second lifting column to the motor via a second shearing drive coupling and a second rotating input shaft;

activating the motor to rotate each drive coupling;

translating the rotation of each drive coupling to vertical motion of a platform;

experiencing a shear force above a predetermined physical threshold of a shearing insert of the first drive coupling, the shearing insert of the first shearing drive coupling configured to have a different shear force tolerance than a shearing insert of the second shearing drive coupling; and disconnecting the motor from the first lifting column.

3. The method of claim 2, wherein the motor is physically attached to the first lifting column via a first rotating input shaft and to a second lifting column via a second rotating input shaft, each rotating input shaft connected to the motor by the first and second shearing drive couplings which further comprise an inner shaft attached to a collar via the shearing inserts.

4. The method of claim 3, wherein for each shearing drive coupling, the shearing insert comprises a polymer material and is positioned in a recess of a protrusion of the input shaft.

5. The method of claim 4, wherein for each shearing drive coupling, the shearing insert fills a portion of a keyed region of an opening in the collar.

6. The method of claim 4, wherein for each shearing drive coupling, the protrusion has a first diameter, the collar has a second diameter, and a body of the first rotating input shaft has a third diameter, the first diameter being less than the second diameter, the third diameter being greater than the second diameter.

7. The method of claim 3, wherein for each shearing drive coupling, the shearing insert is secured via a fastener extending through the collar.

8. The method of claim 3, wherein for each shearing drive coupling, the collar comprises a balance portion disposed between first and second receiving portions.

9. The method of claim 3, wherein the first rotating input shaft has a receiving opening occupied by a lifting shaft connected to the first lifting column.

10. The method of claim 9, wherein the lifting shaft is secured in the receiving opening by a fastener.

11. The method of claim 10, wherein the fastener has a greater shear force threshold than the shearing insert of the first shearing drive coupling.

12. The method of claim 2, wherein the motor is physically disconnected from the first lifting column automatically in response to the experienced shear force.

13. The method of claim 2, wherein the shearing insert of the second shearing drive coupling fails in response to failure of the shearing insert of the first shearing drive coupling.

14. The method of claim 2, wherein the motor automatically enters a protection mode in response to the experienced shear force.

15. The method of claim 2, wherein the experienced shear force breaks the shearing insert of the first shearing drive coupling and causes a drive shaft to spin within a collar of the first shearing drive coupling.

16. The method of claim 2, further comprising replacing the shearing insert of the first shearing drive coupling without replacing a drive shaft or collar of the first shearing drive coupling.

17. The method of claim 2, wherein the shearing insert of the first shearing drive coupling comprises a different material than a drive shaft or collar of the first shearing drive coupling.

18. The method of claim 2, wherein the shearing insert of the first shearing drive coupling comprises a material with the predetermined physical threshold that is less than a force tolerance of the motor.

* * * * *